US005957818A

United States Patent [19]

Betournay

[11] Patent Number: 5,957,818

[45] Date of Patent: Sep. 28, 1999

[54] SQUAT RACK

[76] Inventor: Maurice Betournay, Box 177, Devlin, Ontario, Canada, P0W 1C0

[21] Appl. No.: 09/206,224

[22] Filed: Dec. 7, 1998

[51] Int. Cl.[6] ..... A63B 21/065

[52] U.S. Cl. ..... 482/105; 482/106

[58] Field of Search ..... 482/93, 105, 106, 482/139; 224/201, 265, 266

[56] References Cited

U.S. PATENT DOCUMENTS

| | | | |
|---|---|---|---|
| 3,679,107 | 7/1972 | Perrine | 482/106 |
| 5,211,615 | 5/1993 | Sides | 482/105 |

*Primary Examiner*—John Mulcahy
*Attorney, Agent, or Firm*—A. Battison; M. E. Thrift

[57] ABSTRACT

A squat rack is provided for supporting a bar of weights on a person's neck and shoulders during a squatting exercise. The squat rack includes a neck member arranged to rest on a base of a person's neck and a back member spaced below the neck member being arranged to rest across the person's back. A pair of shoulder members are connected between the neck and back members near respective ends of each of the members. Each shoulder member extends upwards past the neck member and curves forward following an arc arranged to rest on one of the shoulders to terminate at an end extending downwards. A pair of handles are mounted on the respective ends of the shoulder members. A pair of spacer members extend upwards from respective ends of the neck member for mounting a bar support member thereon. The bar support member extends laterally outwards past the respective ends of the neck member. A pair of clamps are mounted at respective ends of the bar support member for securing the bar of weights thereon.

18 Claims, 2 Drawing Sheets

SQUAT RACK

FIELD OF THE INVENTION

This invention relates to a squat rack for supporting free weights on a person's neck and shoulders during a squatting exercise.

BACKGROUND

Squatting is a common exercise when training with free weights mounted on a bar. The exercise is normally accomplished by holding the bar across the back of the shoulders. This places unnecessary stress and discomfort on the back and shoulders.

U.S. Pat. No. 5,211,615 to Sides provides a weight lifting harness apparatus. The apparatus includes a torso plate arranged to rest on a person's back and a pair of curved shoulder straps extending from a top end of the torso plate for supporting a bar of free weights on the person's back and shoulders during a squatting exercise. The apparatus however is rigid and is not able to conform to varying shoulder widths or varying chest thickness' causing discomfort to a person using the apparatus. Added discomfort results from the bar of weights being positioned on the apparatus such that it is pressed against a base of the person's neck and the person's shoulders. The apparatus is unstable and unsafe as it is very narrow in relation to a standard bar used for mounting free weights and it does not adequately secure the bar of weights in place.

SUMMARY

According to one aspect of the present invention there is provided a squat rack for supporting a bar of weights on a person's neck and shoulders during a squatting exercise, the squat rack comprising;

- a neck member having a curved main portion arranged to rest on a base of the person's neck and a pair of end portions each extending from an end of the main portion and being arranged to rest on the person's shoulders;
- a back member spaced below the neck member and being arranged to extend across the person's back;
- a pair of shoulder members having:
  - a first portion extending upwards from the back member at a position near a respective end of the back member to the neck member at a position near a respective end of the neck member;
  - a second portion extending upwards at a first end from an end of the corresponding first portion and curving forwards following an arc arranged to rest on one of the respective shoulders of the person to terminate at a second end extending downwards; and
  - a third portion extending downwards and forwards from the second end of the second portion in the form of a handle for gripping;
- a bar support member mounted on the neck member and extending laterally outwards past respective ends of the neck member; and
- bar securing means for securing the bar of free weights to the bar support member.

Preferably there is provided a pair of spacer members extending upwards and rearwards from respective ends of the neck member mounting the bar support member thereon such that the bar support member is spaced from the person's neck and positioned above the person's centre of gravity in use when the person is in a crouched position.

The back member may be a curved member which is arranged to extend across an upper portion of the person's back such that the back member does not interfere with a crouching movement.

Preferably the second portion of each shoulder member is made of flexible material such that the second end of the second portion of each shoulder member may be flexed inwards for fitting various chest thickness'.

Preferably there are provided bolts inserted through a set of co-operating apertures in the neck member, the back member and each shoulder member fastening each shoulder member to the neck and back members wherein the bolts are repositionable within the set of apertures such that the pair of shoulder members are adjustable to various shoulder widths.

The bar support member is preferably longer than a width of the shoulders of the person for balancing the bar of weights supported on the bar support member.

It is preferred that the bar securing means comprises a pair of clamps mounted on respective ends of the bar support member, each clamp being arranged to receive the bar of weights therein for securing the bar of weights to the bar support member.

The third portions of the shoulder members preferably extend from the respective second portions at an incline away from each other.

According to a second aspect of the present invention there is provided a squat rack for supporting a bar of weights on a person's neck and shoulders during a squatting exercise, the squat rack comprising;

- a neck member arranged to rest on a base of the person's neck and on the person's shoulders;
- a curved back member spaced below the neck member and being arranged to extend across an upper portion of the person's back such that the back member does not interfere with a crouching movement of the person;
- a pair of shoulder members having:
  - a first portion extending upwards from the back member at a position near a respective end of the back member to the neck member at a position near a respective end of the neck member;
  - a second portion extending upwards at a first end from an end of the corresponding first portion and curving forwards following an arc arranged to rest on one of the respective shoulders of the person to terminate at a second end extending downwards; and
  - a third portion extending downwards and forwards from the second end of the second portion in the form of a handle for gripping;
- a bar support member mounted on the neck member and extending laterally outwards past respective ends of the neck member; and
- bar securing means for securing the bar of free weights to the bar support member.

According to a further aspect of the present invention there is provided a squat rack for supporting a bar of weights on a person's neck and shoulders during a squatting exercise, the squat rack comprising;

- a neck member arranged to rest on a base of the person's neck and on the person's shoulders;
- a back member spaced below the neck member and being arranged to extend across the person's back;
- a pair of shoulder members having:
  - a first portion extending upwards from the back member at a position near a respective end of the back member to the neck member at a position near a respective end of the neck member;

a second portion extending upwards at a first end from an end of the corresponding first portion and curving forwards following an arc arranged to rest on one of the respective shoulders of the person to terminate at a second end extending downwards; and a third portion extending downwards and forwards from the second end of the second portion in the form of a handle, the handles being arranged to extend from the respective second portions at an incline away from each other for gripping the handles comfortably;

a bar support member mounted above the neck member and extending laterally outwards past respective ends of the neck member; and bar securing means for securing the bar of free weights to the bar support member.

BRIEF DESCRIPTION OF THE DRAWINGS

In the accompanying drawings, which illustrate an exemplary embodiment of the present invention.

DETAILED DESCRIPTION

Figure 2:
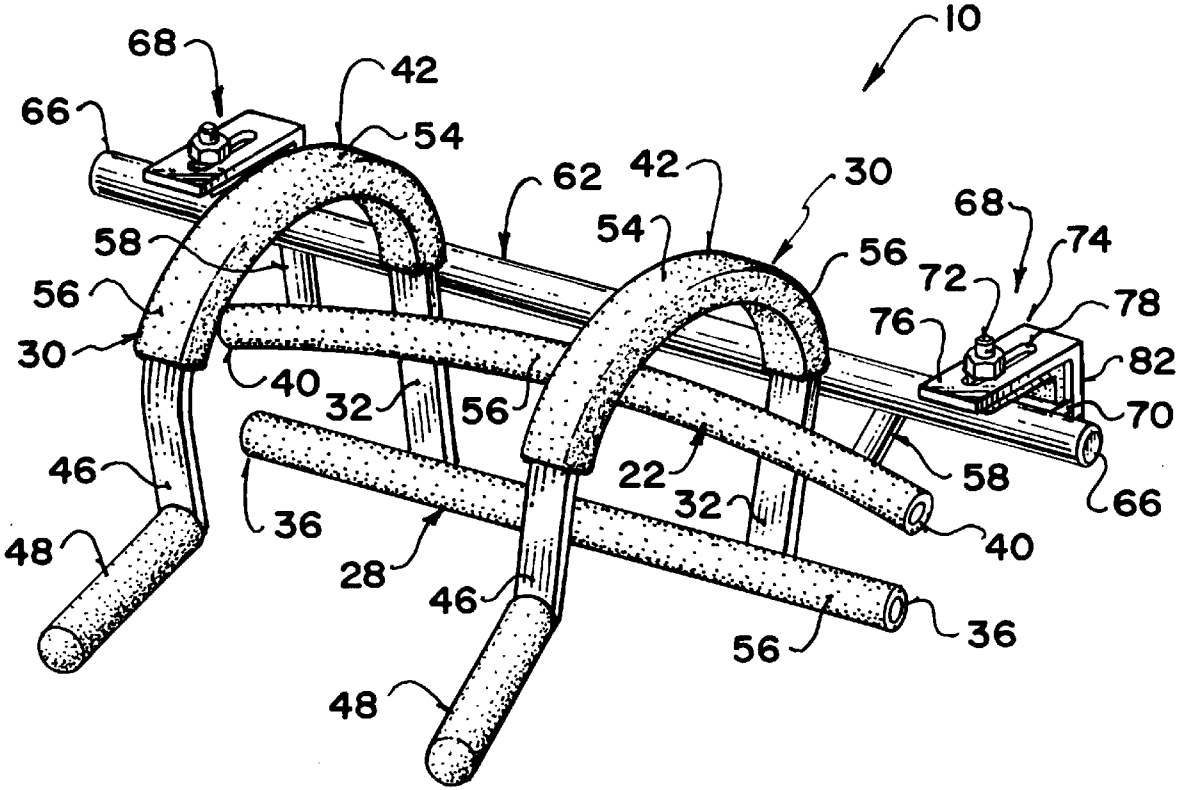
FIG. 2 is an isometric view of the squat rack.
Figure 1:
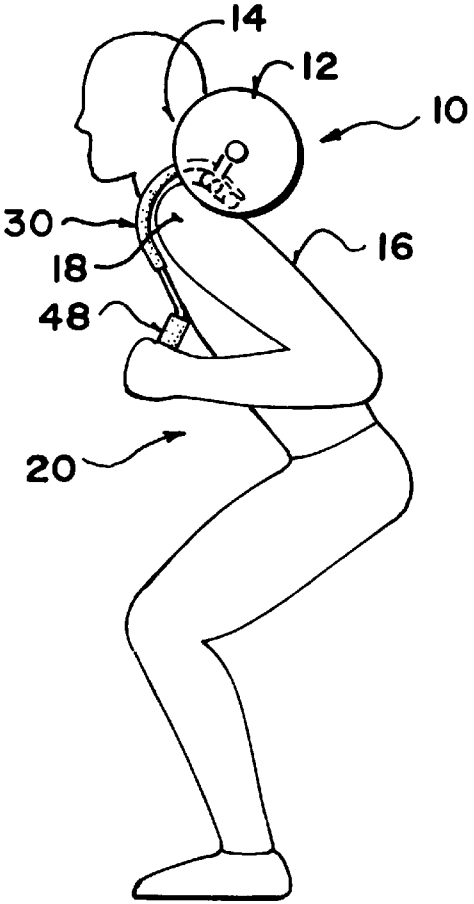
FIG. 1 is a side elevation view of the squat rack as it is used in a squatting exercise.
Figure 3:
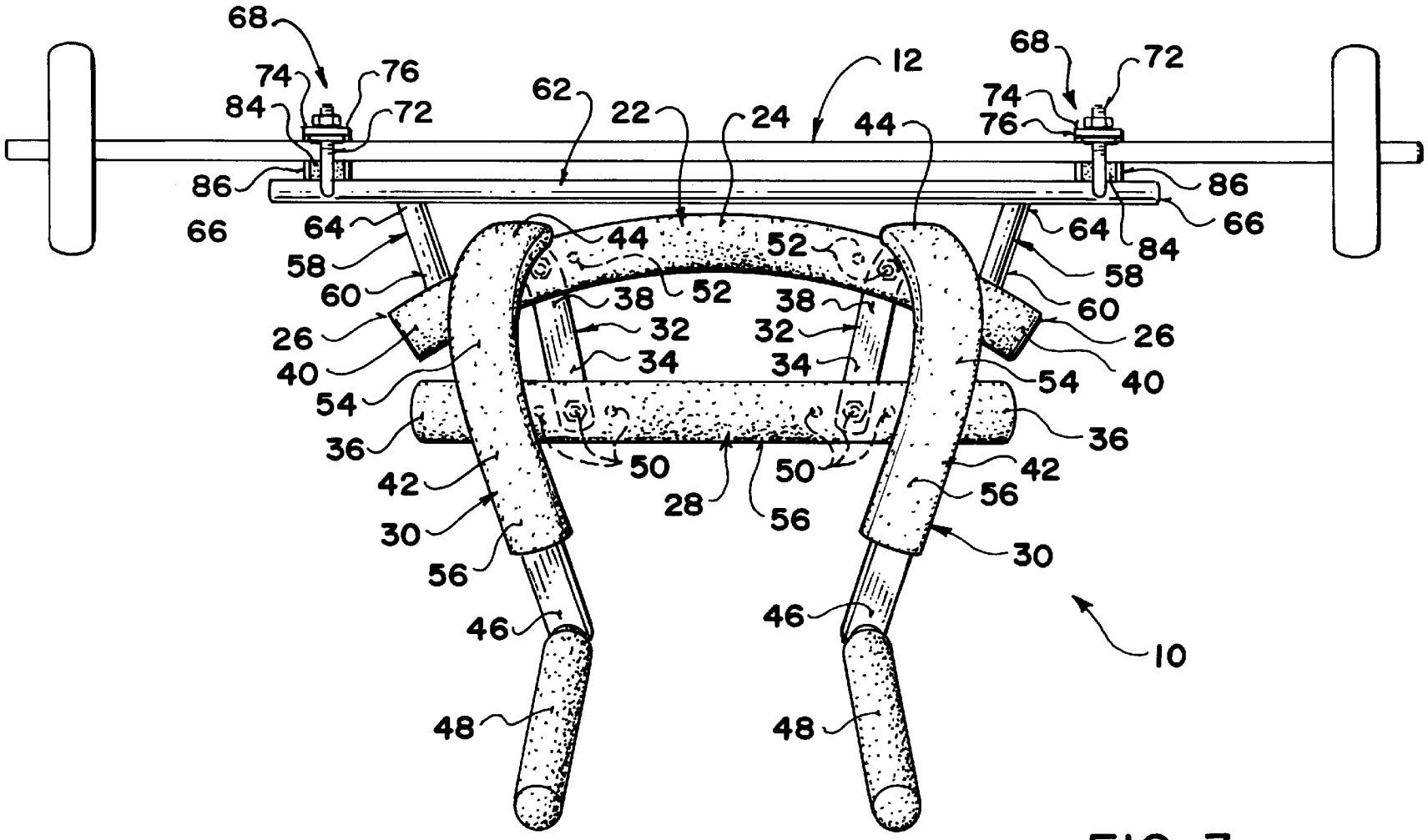
FIG. 3 is an isometric view of the squat rack showing the front and top sides with a bar of weights mounted on the bar support member.

Referring to the accompanying drawings, there is illustrated a squat rack generally indicated by the number 10. The squat rack 10 is for supporting a bar of free weights 12 on a neck 14, a back 16 and shoulders 18 of a person 20.

The squat rack 10 includes a neck member 22 having a curved main portion 24 arranged to form a yoke around a base of the person's neck and a pair of end portions 26 which extend outwards from the ends of the curved main portion 24 for resting on the person's shoulders. The neck member 22 is a rigid bar of circular cross section.

A back member 28 of similar length to the neck member 22 is positioned below and spaced from the neck member. The back member 28 is a curved rigid bar of circular cross section arranged to extend across an upper portion of the person's back. The back member thus does not interfere with the freedom of the person's movement as the person's flexes their back in the squatting exercise.

A pair of shoulder members 30 connect the neck and back members 22 and 28. Each shoulder member 30 includes a first portion 32 bolted at a first end 34 to a back side of the back member 28 towards an end 36 of the back member. The first portion 32 extends upwards and is bolted at a second end 38 to a back side of the neck member 22 towards an end 40 of the neck member. The first portion 32 of each shoulder member 30 is a flat bar made of steel of rectangular cross section.

Each shoulder member 30 includes a second portion 42 which extends upwards at a first end 44 from the corresponding first portion 32. The second portion 42 curves forwards and then downwards in a smooth arc which terminates at a second end 46. The second portion 42 of each shoulder member is a flat bar made of steel of rectangular cross section which is arranged to flex slightly inwards when force is applied inwards at the second end 46.

Each shoulder member 30 includes a third portion 48 which is arranged to extend downwards and outwards from the person's chest. The third portions 48 are also inclined slightly so as to extend away from each other for providing a more comfortable gripping position. The third portion 48 of each shoulder member 30 is a bar of steel of circular cross section which is welded to the second end 46 of the second portion 42. The third portion 30 is coated in rubber or plastic such that the third portion forms a comfortable and secure grip for gripping with the person's hand.

The shoulder members 30 are arranged to fit over the person's respective shoulders and flex inwards when the handles are held against the person's chest such that the squat rack 10 fits snugly on the person's torso.

The shoulder members 30 are bolted to the neck member 22 by inserting a bolt through each shoulder member and through a co-operating set of apertures 50 in the neck member. The apertures 50 are spaced along the length of the neck member. The shoulder members 30 may be bolted at any aperture of the set of apertures 50 such that the spacing between the shoulder members is adjustable for fitting different shoulder widths.

The shoulder members 30 are bolted to the back member 28 by inserting a bolt through each shoulder member and through a co-operating set of apertures 52 in the back member. The apertures 52 are spaced along the length of the back member. The shoulder members 30 may be bolted at any aperture of the set of apertures corresponding to the apertures 50 of the neck member where the shoulder members are also bolted.

The neck member 22, the back member 28 and an upper portion 54 of the shoulder members 30 are covered with a dense foam padding 56 for cushioning against the person's torso. All components of the squat rack which contact the person are thus covered for ensuring a comfortable fit when the squat rack is used.

A pair of spacer members 58 extend outwards from the respective ends 40 of the neck member 22 at a rearwards and upwards incline. The spacer members are bars of circular cross section welded to the neck member at a first end 60 of each spacer member.

A bar support member 62 is mounted on a second end 64 of both spacer members 58 such that the bar support member extends parallel to the back member 28 at a position spaced upwards from the neck member 22. The bar support member 62 extends laterally outwards past each end 36 of the neck member 22 to terminate at respective ends 66 of the bar support member. The bar support member 62 is arranged to be longer than an average person's shoulder width for ensuring a wide and balanced support for mounting the bar of weight thereon.

A clamp 68 is mounted at both ends 66 of the bar support member. Each clamp 68 includes a support flange 70 extending rearwards from the bar support member and a threaded rod 72 extending upwards from the bar support member. An L-shaped clamping member 74 is secured on a top side of the bar support member. The clamping member 74 includes a top flange 76 which fits over the threaded rod for engaging a top side of the bar of weights. The threaded rod 72 is inserted through an aperture 78 in the top flange and is bolted on a top side thereof. A rear flange 80 extends downwards from a rear end 82 of the top flange 76 for engaging a back side of the bar of weights. A layer of resilient gripping material 84 such as rubber is mounted adjacent an inner face 86 for further securing the bar of weights within the clamps 68.

The spacer members 58 are arranged such that the bar of weights mounted on the bar support member is positioned directly over the person's centre of gravity when the person is in a crouched position. The spacer members 58 hold the bar of weights spaced from the person such that the bar does not contact the person directly for distributing the weight of the bar across the neck member, the back member and the shoulder members.

In a further embodiment the bar support member 62 may be modified by removing the clamps 68. In place of the clamps 68, weights may be mounted directly onto the ends 66 of the bar support member 62 and modified clamps may be used to secure the weights onto the bar support member.

While two embodiments of the present invention have been described in the foregoing, it is to be understood that other embodiments are possible within the scope of the invention. The invention is to be considered limited solely by the scope of the appended claims.

I claim:

1. A squat rack for supporting a bar of weights on a person's neck and shoulders during a squatting exercise, the squat rack comprising;

a neck member having a curved main portion arranged to rest on a base of the person's neck and a pair of end portions each extending from an end of the main portion and being arranged to rest on the person's shoulders;

a back member spaced below the neck member and being arranged to extend across the person's back;

a pair of shoulder members having:

a first portion extending upwards from the back member at a position near a respective end of the back member to the neck member at a position near a respective end of the neck member;

a second portion extending upwards at a first end from an end of the corresponding first portion and curving forwards following an arc arranged to rest on one of the respective shoulders of the person to terminate at a second end extending downwards; and a third portion extending downwards and forwards from the second end of the second portion in the form of a handle for gripping;

a bar support member mounted on the neck member and extending laterally outwards past respective ends of the neck member; and bar securing means for securing the bar of free weights to the bar support member.

2. The squat rack of claim 1 wherein there is provided a pair of spacer members extending upwards and rearwards from respective ends of the neck member mounting the bar support member thereon such that the bar support member is arranged to be spaced from the person's neck and positioned above the person's centre of gravity in use when the person is in a crouched position.

3. The squat rack of claim 1 wherein the back member is a curved member which is arranged to extend across an upper portion of the person's back such that the back member does not interfere with a crouching movement.

4. The squat rack of claim 1 wherein the second portion of each shoulder member is made of flexible material such that the second end of the second portion of each shoulder member may be flexed inwards for fitting various chest thickness'.

5. The squat rack of claim 1 wherein there are provided bolts inserted through a set of co-operating apertures in the neck member, the back member and each shoulder member fastening each shoulder member to the neck and back members wherein the bolts are repositionable within the set of apertures such that the pair of shoulder members are adjustable to various shoulder widths.

6. The squat rack of claim 1 wherein the bar securing means comprises a pair of clamps mounted on respective ends of the bar support member, each clamp being arranged to receive the bar of weights therein for securing the bar of weights to the bar support member.

7. The squat rack of claim 1 wherein the third portions of the shoulder members extend from the respective second portions at an incline away from each other.

8. A squat rack for supporting a bar of weights on a person's neck and shoulders during a squatting exercise, the squat rack comprising;

a neck member arranged to rest on a base of the person's neck and on the person's shoulders;

a curved back member spaced below the neck member and being arranged to extend across an upper portion of the person's back such that the back member does not interfere with a crouching movement of the person;

a pair of shoulder members having:

a first portion extending upwards from the back member at a position near a respective end of the back member to the neck member at a position near a respective end of the neck member;

a second portion extending upwards at a first end from an end of the corresponding first portion and curving forwards following an arc arranged to rest on one of the respective shoulders of the person to terminate at a second end extending downwards; and a third portion extending downwards and forwards from the second end of the second portion in the form of a handle for gripping;

a bar support member mounted on the neck member and extending laterally outwards past respective ends of the neck member; and bar securing means for securing the bar of free weights to the bar support member.

9. The squat rack of claim 8 wherein there is provided a pair of spacer members extending upwards and rearwards from respective ends of the neck member mounting the bar support member thereon such that the bar support member is arranged to be spaced from the person's neck and positioned above the person's centre of gravity in use when the person is in a crouched position.

10. The squat rack of claim 8 wherein the second portion of each shoulder member is made of flexible material such that the second end of the second portion of each shoulder member may be flexed inwards for fitting various chest thickness'.

11. The squat rack of claim 8 wherein there are provided bolts inserted through a set of co-operating apertures in the neck member, the back member and each shoulder member fastening each shoulder member to the neck and back members wherein the bolts are repositionable within the set of apertures such that the pair of shoulder members are adjustable to various shoulder widths.

12. The squat rack of claim 8 wherein the bar securing means comprises a pair of clamps mounted on respective ends of the bar support member, each clamp being arranged to receive the bar of weights therein for securing the bar of weights to the bar support member.

13. The squat rack of claim 8 wherein the third portions of the shoulder members extend from the respective second portions at an incline away from each other.

14. A squat rack for supporting a bar of weights on a person's neck and shoulders during a squatting exercise, the squat rack comprising;

a neck member arranged to rest on a base of the person's neck and on the person's shoulders;

a back member spaced below the neck member and being arranged to extend across the person's back;

a pair of shoulder members having:

a first portion extending upwards from the back member at a position near a respective end of the back member to the neck member at a position near a respective end of the neck member;

a second portion extending upwards at a first end from an end of the corresponding first portion and curving forwards following an arc arranged to rest on one of the respective shoulders of the person to terminate at a second end extending downwards; and a third portion extending downwards and forwards from the second end of the second portion in the form of a handle, the handles being arranged to extend from the respective second portions at an incline away from each other for gripping the handles comfortably;

a bar support member mounted on an above the neck member and extending laterally outwards past respective ends of the neck member; and bar securing means for securing the bar of free weights to the bar support member.

15. The squat rack of claim 14 wherein there is provided a pair of spacer members extending upwards and rearwards from respective ends of the neck member mounting the bar support member thereon such that the bar support member is arranged to be spaced from the person's neck and positioned above the person's centre of gravity in use when the person is in a crouched position.

16. The squat rack of claim 14 wherein the second portion of each shoulder member is made of flexible material such that the second end of the second portion of each shoulder member may be flexed inwards for fitting various chest thickness'.

17. The squat rack of claim 14 wherein there are provided bolts inserted through a set of co-operating apertures in the neck member, the back member and each shoulder member fastening each shoulder member to the neck and back members wherein the bolts are repositionable within the set of apertures such that the pair of shoulder members are adjustable to various shoulder widths.

18. The squat rack of claim 14 wherein the bar securing means comprises a pair of clamps mounted on respective ends of the bar support member, each clamp being arranged to receive the bar of weights therein for securing the bar of weights to the bar support member.

* * * * *